US009145194B2

(12) United States Patent
Marks et al.

(10) Patent No.: US 9,145,194 B2
(45) Date of Patent: Sep. 29, 2015

(54) APPARATUS AND METHODS FOR STABILIZING WATERCRAFT DURING TRANSPORT

(76) Inventors: David Marks, Vidor, TX (US); Darrell Marks, Beaumont, TX (US)

( * ) Notice: Subject to any disclaimer, the term of this patent is extended or adjusted under 35 U.S.C. 154(b) by 476 days.

(21) Appl. No.: 13/385,639

(22) Filed: Feb. 28, 2012

(65) Prior Publication Data

US 2013/0221187 A1 Aug. 29, 2013

(51) Int. Cl.
*B63H 20/36* (2006.01)

(52) U.S. Cl.
CPC ..... *B63H 20/36* (2013.01)

(58) Field of Classification Search
USPC ..... 248/640, 642; 440/53, 55
See application file for complete search history.

(56) References Cited

U.S. PATENT DOCUMENTS

| | | | | |
|---|---|---|---|---|
| 3,952,986 | A | | 4/1976 | Wells |
| 4,052,952 | A | | 10/1977 | Hale et al. |
| 4,125,236 | A | | 11/1978 | Landwerlen |
| 4,271,548 | A | | 6/1981 | Alberts |
| 4,331,431 | A | | 5/1982 | Estes |
| 4,438,899 | A | | 3/1984 | Perkins et al. |
| 4,501,561 | A | | 2/1985 | Speelman |
| 4,624,438 | A | | 11/1986 | Goodman |
| 4,650,427 | A | | 3/1987 | Huchinson |
| 4,651,964 | A | | 3/1987 | Kendrick |
| 4,685,888 | A | | 8/1987 | Brewer |
| 4,687,448 | A | | 8/1987 | Peirce |
| 4,757,971 | A | | 7/1988 | Mapes |
| 4,813,365 | A | | 3/1989 | Lindstrom et al. |
| 4,828,186 | A | * | 5/1989 | Weiss ..... 248/640 |
| 4,842,239 | A | | 6/1989 | Kinsey |
| 4,863,405 | A | | 9/1989 | Hervat et al. |
| 4,872,857 | A | | 10/1989 | Newman et al. |
| 4,890,811 | A | | 1/1990 | Ehni |
| 4,911,395 | A | | 3/1990 | Jones |
| 4,925,410 | A | | 5/1990 | Boda |
| 4,929,202 | A | | 5/1990 | Tengelitsch |
| 4,993,978 | A | | 2/1991 | Johannes |
| 4,998,496 | A | | 3/1991 | Shaw |
| 5,021,016 | A | | 6/1991 | Currey |
| 5,031,842 | A | | 7/1991 | Mohr |
| 5,083,948 | A | | 1/1992 | Grobson |
| 5,100,349 | A | | 3/1992 | Perkins et al. |
| 5,174,542 | A | | 12/1992 | DeLeeuw |
| 5,186,428 | A | | 2/1993 | Falkenberg |
| 5,340,077 | A | | 8/1994 | Tyler |
| 5,350,329 | A | | 9/1994 | Haman |
| 5,393,251 | A | | 2/1995 | Gilbert |
| 5,525,082 | A | | 6/1996 | Lee et al. |
| 5,549,494 | A | | 8/1996 | Fosmer |
| 5,725,403 | A | | 3/1998 | Ridolfo |
| 5,755,603 | A | | 5/1998 | Kumita |
| 5,775,669 | A | | 7/1998 | Huggins et al. |
| 5,795,202 | A | | 8/1998 | Williams |

(Continued)

*Primary Examiner* — Steven Marsh

(57) ABSTRACT

Apparatuses and methods for stabilizing an outboard motor of a watercraft during transport by a towed vehicle include a body having an outer member secured to the towed vehicle and an inner member disposed within and telescopingly movable relative to the outer member, the inner member having a head usable to contact and stabilize the outboard motor. A biasing member urges the inner member toward a retracted position. The inner member includes a first portion pivotally movable relative to a second portion, between an angled and a straight position. Contact between the first portion and the outer member prevents movement of the inner member toward the retracted position.

10 Claims, 7 Drawing Sheets

(56) References Cited

U.S. PATENT DOCUMENTS

| | | | | |
|---|---|---|---|---|
| 6,076,796 | A | 6/2000 | Huggins et al. | |
| 6,152,064 | A | 11/2000 | Morton | |
| 6,174,211 | B1 | 1/2001 | Nakamura | |
| 6,283,806 | B1 | 9/2001 | Schmidt et al. | |
| 6,425,787 | B1 | 7/2002 | Hersom | |
| 6,447,350 | B2 | 9/2002 | Thompson et al. | |
| 6,494,431 | B1 | 12/2002 | McCoy | |
| 6,513,782 | B2 | 2/2003 | Fischer | |
| 6,585,224 | B1 | 7/2003 | Schmidt | |
| 6,659,817 | B1 | 12/2003 | Anderson et al. | |
| 6,948,834 | B2 | 9/2005 | Lilly | |
| 7,335,073 | B1 | 2/2008 | Christian | |
| 7,407,419 | B2 * | 8/2008 | Douglas | 440/53 |
| 7,556,545 | B2 | 7/2009 | Draghici | |
| 2001/0044243 | A1 * | 11/2001 | Thompson et al. | 440/55 |
| 2004/0262488 | A1 | 12/2004 | Kozubski | |
| 2008/0029683 | A1 * | 2/2008 | Draghici | 248/640 |

* cited by examiner

APPARATUS AND METHODS FOR STABILIZING WATERCRAFT DURING TRANSPORT

FIELD

Embodiments usable within the scope of the present disclosure relate, generally, to apparatuses and methods usable to stabilize a first object relative to a second object, and more specifically, to apparatuses and methods usable to reduce undesired movement of an outboard motor or other portion of a watercraft during transport thereof (e.g., by a trailer or similar towed vehicle).

BACKGROUND

A significant number of recreational and commercial watercraft utilize an outboard motor as a primary source of propulsion and/or steering. A typical outboard motor is a self-contained unit that includes an engine, gearbox, and propeller or jet drive, which is affixed to the transom (e.g., the back wall of the hull) of a boat. An outboard motor is normally secured over the transom in a manner that enables the motor to be pivoted and/or otherwise moved to change the direction of the thrust, thus steering the boat.

As a result, when a watercraft is out of the water, such as during transport (e.g., via trailer), the outboard motor thereof is inclined to move relative to the transom and/other portions of the watercraft or transport vehicle as the transport vehicle moves. This movement can cause the motor to undesirably impact the transom or other portions of the watercraft and/or the transport vehicle, which can damage or destroy the transom or other portions of the watercraft, the outboard motor, and/or the trailer or other transport/towed vehicle.

To prevent undesired movement of an outboard motor during transport of a watercraft, various "transom saver" apparatuses exist. Generally, conventional transom saver devices include an arm designed to be temporarily attached to and/or braced against a portion of a trailer at one end, while the other end includes a forked head, grippers, or a similar type of contact member designed to contact the outboard motor and prevent movement thereof by transferring at least a portion of the torque and/or other forces experienced by the motor to the trailer. The arm and/or head is typically adjustable in some manner to accommodate the specific placement of the apparatus within the trailer and the type and/or dimensions of the trailer or watercraft.

Conventional transom savers are somewhat cumbersome devices, which must be stored loose, within the trailer, towing vehicle, or watercraft when not in use. As such, these devices are prone to loss, theft, or damage. Additionally, when lowering a trailer and/or watercraft into a body of water to launch the watercraft, it is common for a transom saver to be lost in the water during this process. Further, an individual transom saver is often usable only with certain types and/or sizes of trailers, boats, and/or motors, while portions of the transom saver, or the entire device, must be interchanged to accommodate different products.

A need exists for apparatuses for stabilizing outboard motors and/or other portions of a watercraft, or other objects, during transport by a towed vehicle, that can be securely attached to the towed vehicle to prevent loss thereof, adjustable to accommodate any spacing between a towed vehicle and an outboard motor, and can be retractable or otherwise movable to a position underneath or otherwise in association with the towed vehicle to facilitate storage when not in use.

Embodiments usable within the scope of the present disclosure meet these needs.

SUMMARY

Embodiments usable within the scope of the present disclosure include apparatuses usable to stabilize an object (e.g., an outboard motor of a watercraft) during transport by a towed vehicle (e.g., a trailer). Generally, the apparatus can include a body secured to the towed vehicle (e.g., at a first end thereof), having a head (e.g., at a second end thereof), the body being movable relative to the towed vehicle (e.g., telescopingly and/or pivotally) such that the head can be moved to contact at least a portion of the object to be stabilized.

More specifically, embodiments usable within the scope of the present disclosure can include an apparatus usable to stabilize an outboard motor of a watercraft during transport by a towed vehicle, the apparatus including a body having an outer member being secured to and/or part of the towed vehicle, and an inner member disposed within and telescopingly movable relative to the outer member, between an extended position and a retracted position. Alternatively, in other embodiments, the outer member could be telescopingly movable relative to the inner member, while the inner member is secured to and/or part of the towed vehicle without departing from the scope of the present disclosure. In an embodiment, the body can be secured to and/or a part of the underside of a trailer or similar towed vehicle, such that when moved into a retracted position, the apparatus is disposed substantially beneath the trailer for convenient storage. Alternatively, the body could be secured to and/or part of the upper side of a trailer or towed vehicle, the inner or outer surfaces of the walls thereof, or any other portion of the trailer or other towed vehicle, as desired.

In an embodiment, at least one of the outer and inner members can include an opening (e.g., a slot) formed therein, while the other thereof can include a protruding member (e.g., a pin, bolt, screw, or similar integral or separate member that extends therefrom). The protruding member can thereby extend into the opening such that contact between the protruding member and the perimeter of the opening limits movement of the inner member relative to the outer member.

A biasing member, such as a spring, can be engaged with the inner member (e.g., attached to the inner member and the towed vehicle, or to the inner member and the outer member), such that the inner member is continuously or selectively urged toward a retracted position. The inner member can include two portions, the first portion being pivotally movable relative to a second portion (e.g., at a hinge, a pin-in-hole connection, or a similar type of pivot point), between an angled position and a straight position. In an embodiment, contact between the first portion of the inner member and the outer member can prevent movement of the inner member toward the retracted position (e.g., by resisting the force of the spring or other biasing member). For example, at least one of the first portion and the outer member can include a protruding portion that contacts the other of the first portion and the outer member when the first portion is in an angled position, thereby preventing retraction of the inner member.

A head can be formed at and/or secured to an end of the inner member, the head being adapted to contact and stabilize an outboard motor during transport. For example, the head can include spring-biased contact plates, grippers, jaws, frictional surfaces, or any other manner of engagement usable to reduce motion of the outboard motor when contacted. In an embodiment, the head can be adjustably secured to the inner member, e.g., using a series of selectable pin-in-hole connections, for accommodating different distances between a trailer and an outboard motor. In a further embodiment, the head can be removable from the body, e.g., to enable replacement thereof with an additional/alternate head adapted for a different type of engagement and/or for accommodating motors, trailers, and/or watercraft of differing sizes or having differing distances therebetween.

In use the body of an apparatus can be provided into engagement with a towed vehicle (e.g., secured to and/or part of the underside or another portion thereof). A first member of the body can be telescopingly moved outward from the towed vehicle relative to the second member to accommodate a horizontal distance between the outboard motor or other object to be secured and the towed vehicle. A first portion of the first member can be pivoted relative to a second portion thereof, angularly moving the first portion such that the head thereon contacts the outboard motor. When not in use, the first member can be telescopingly moved inward (e.g., when urged by a spring or other type of biasing member) to place the device substantially underneath, over, or alongside the towed vehicle for storage, such that the apparatus remains connected to and/or in association with the vehicle to prevent loss, theft, or undesired movement of and/or damage thereto. In an embodiment, when pivoted to an angled position, retraction of the device can be prevented (e.g., through contact between the first and second members thereof).

Embodiments usable within the scope of the present disclosure thereby include apparatuses and methods for stabilizing outboard motors and/or other objects during transport, that can include a secure engagement between a stabilizing device and a towed vehicle to prevent loss of the device, the device further being retractable or otherwise movable to a position underneath or otherwise in association with the towed vehicle to facilitate storage.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Embodiments usable within the scope of the present disclosure include apparatuses usable to stabilize (e.g., contact) an outboard motor of a watercraft during transport thereof that can be secured to and/or retracted beneath, over, and/or adjacent to the vehicle used for transport of the watercraft.

Figure 1:
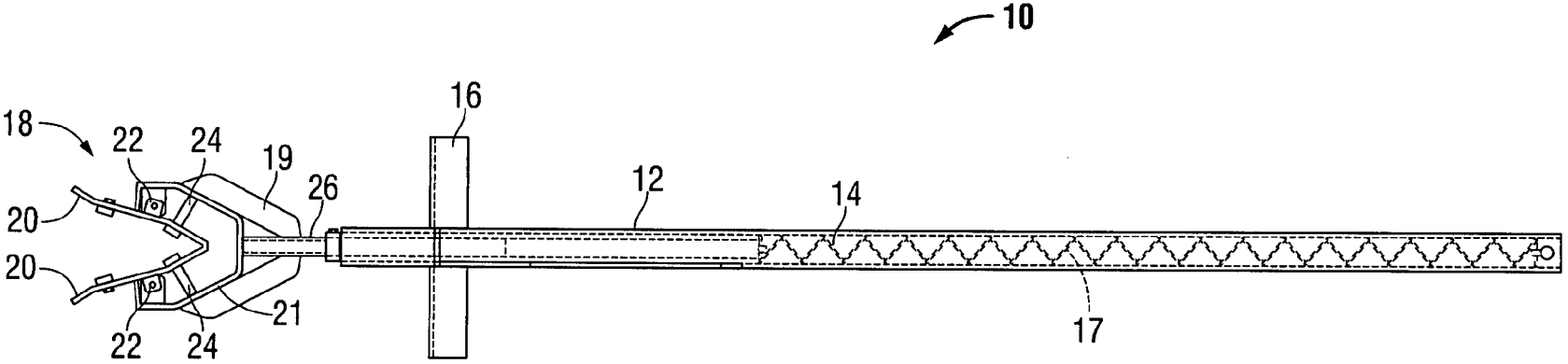
FIG. 1 depicts a top view of an embodiment of an apparatus for stabilizing an outboard motor of a watercraft usable within the scope of the present disclosure.

FIG. 1 depicts a diagrammatic top view of an embodiment of an apparatus (10) usable for such a purpose. The apparatus is shown including an outer member, e.g., a housing (12) disposed about an inner member (14). The housing (12) is shown including flanges (16) for mounting the apparatus (10) to a trailer or similar towed vehicle (e.g., using bolts or similar fasteners); however, other methods of connection (e.g., welding, adhesive, magnets, etc.) are also usable. Further, in an embodiment, the housing (12) can be an integral part of a trailer or other towed vehicle, into which the inner member (14) can be installed. In further embodiments, trailers could be constructed to integrally include embodiments of the present apparatus (10) for use therewith. In the depicted embodiment, the inner member (14) is biased toward a retracted position by a spring (17) connected to a pin and/or other protruding portion of the housing (12).

Figure 5A:
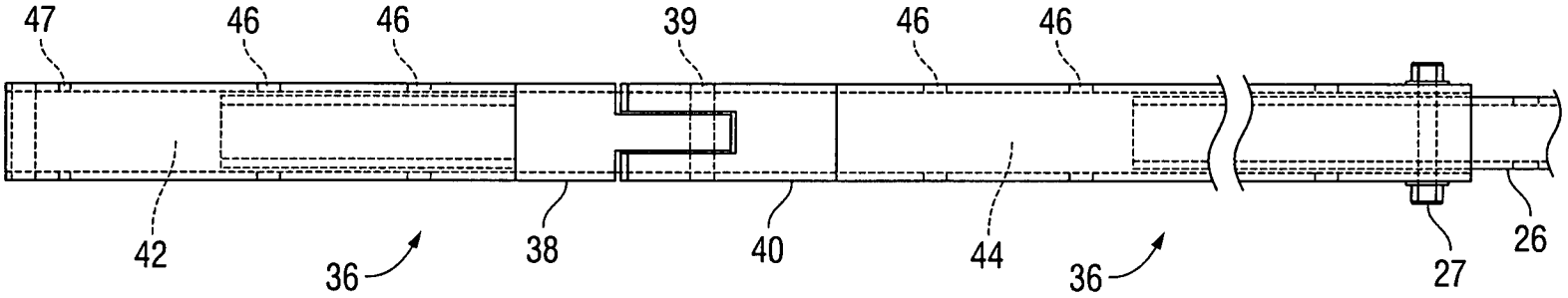
FIG. 5A depicts a top view of an embodiment of a hinge assembly usable to connect portions of an inner member of the apparatus of FIG. 1.
Figure 5B:
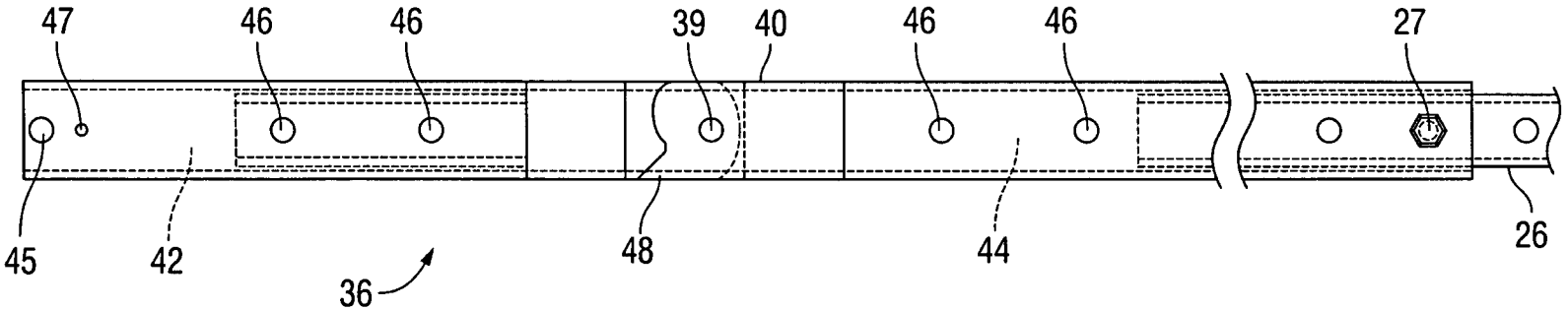
FIG. 5B depicts a side view of the hinge assembly of FIG. 5A.

A head (18) is shown secure to an end of the inner member (14) by insertion of a shaft portion (26) of the head (18) into the hollow bore of the inner member (14), e.g., using a pin-in-hole engagement, such as that shown in FIGS. 5A and 5B; however, it should be understood that in various embodiments, the head (18) could be secured to the inner member (14) using other methods of fastening, or the head (18) could be integrally formed as a part of the inner member (14) while the inner member (14) could be removed from the housing (12) when it is desired to replace and/or interchange the head (18).

While the specific form and/or structural components of the head (18) can vary depending on the type and/or dimensions of the object to be secured and/or those of the towed vehicle, FIG. 1 depicts the head (18) having support members (19) that engage a forked plate (21), e.g., via welding. Two contact members (20) are shown pivotally engaged to the forked plate (21) at pivot points (22) (e.g., hinges and/or pin-in-hole connections), the inner portion of the contact members (20) being biased outward by springs (24), such that constant force (e.g., a gripping force) by the contact members (20) is applied to an outboard motor or other object contacted by the contact members (20).

Figure 2A:
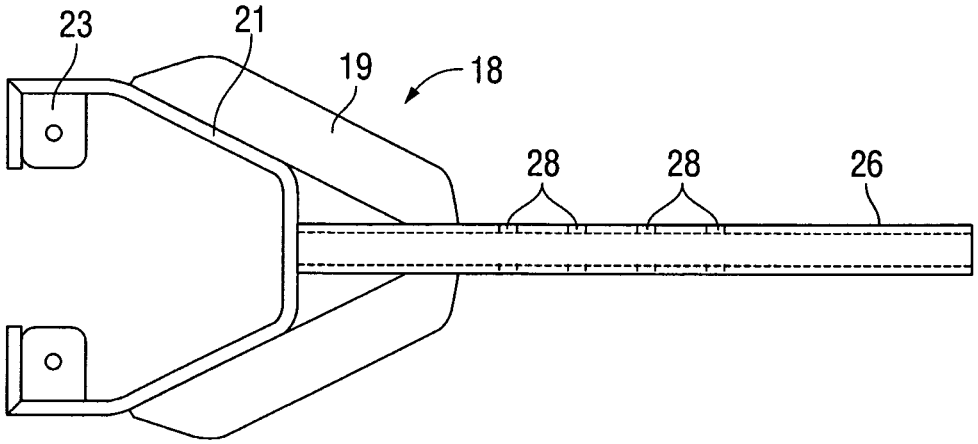
FIG. 2A depicts a top view of an embodiment of a head usable with the apparatus of FIG. 1.
Figure 2B:
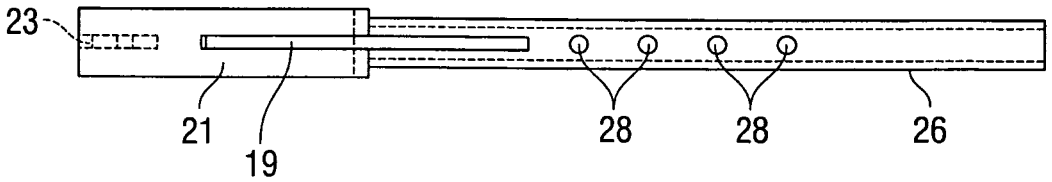
FIG. 2B depicts a side view of the head of FIG. 2A.

FIGS. 2A and 2B depict diagrammatic top and side views of the head (18), respectively, with the contact members removed such that flanges (23) for attachment thereto can be visualized extending from the forked plate (21). Multiple holes (28) (e.g., through-bores) are shown extending through the shaft portion (26) of the head (18), enabling the head (18) to be adjustably connected to the inner member by selecting one of the plurality of holes (28) through which a pin or similar object can be inserted, to secure the head (18) to the inner member. Adjustably positioning the head (18) relative to the inner member in this manner enables the length of the apparatus to be modified, as needed, to accommodate differing distances, e.g., between a base and/or underside of a trailer and an outboard motor.

Figure 3A:
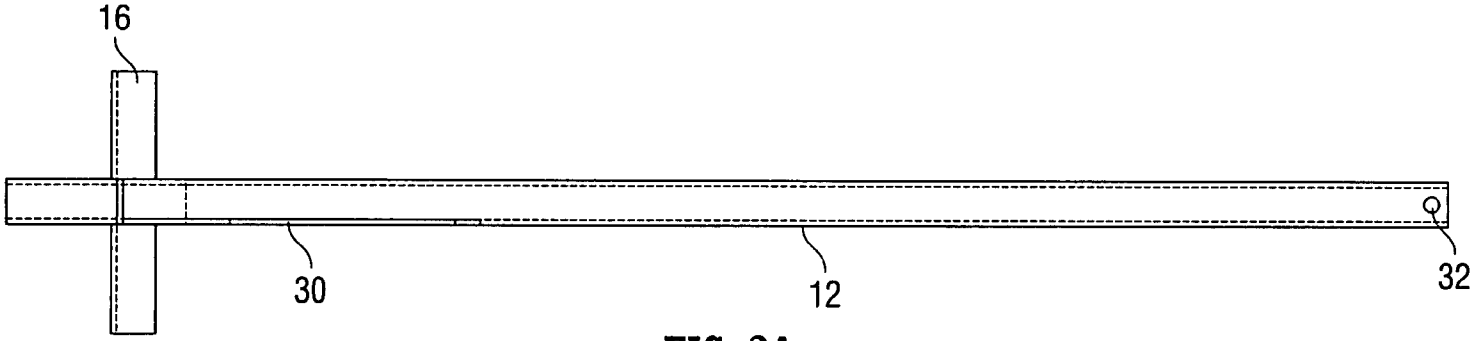
FIG. 3A depicts a top view of an embodiment of an outer member of the apparatus of FIG. 1.
Figure 3B:
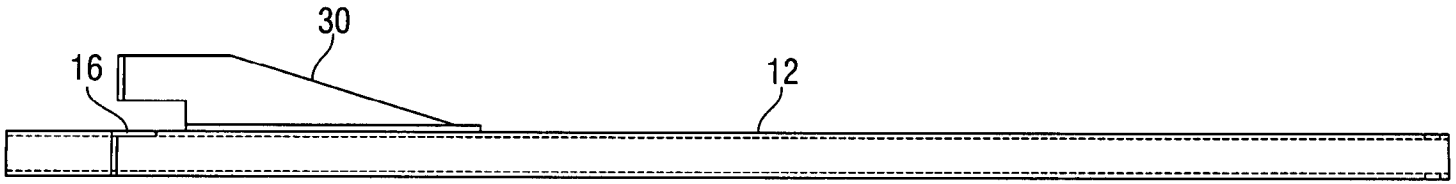
FIG. 3B depicts a side view of the outer member of FIG. 3A.
Figure 3C:
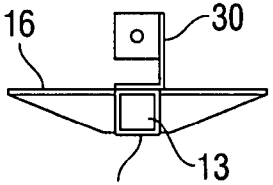
FIG. 3C depicts an end view of the outer member of FIG. 3A.

FIGS. 3A, 3B, and 3C depict diagrammatic top, side, and end views of the housing (12), respectively. The housing (12) is shown as a generally tubular body (e.g., a piece of aluminum square tubing); however, it should be understood that in various embodiments, the housing (12) could be cylindrical, or have any other desirable shape, and that all, a portion, or none of the housing (12) may be solid rather than hollow, as shown. The depicted embodiment of the housing (12) is shown having a hollow bore (13) therein, into which the inner member can be inserted and secured (e.g., through one or multiple pin-in-hole connections or similar means of fastening). An upper flange (30) is also shown, in addition to the flanges (16) extending from the sides of the housing (12), described previously. A counter-sunk screw (32) is also shown secured within the end of the housing (12), which can be used to secure the housing (12) to the inner member and/or to facilitate limiting the movement of the inner member relative thereto in the manner described previously and below.

Figure 4A:
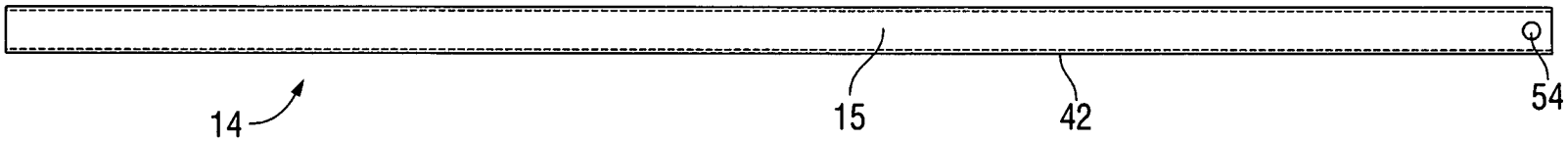
FIG. 4A depicts a top view of an embodiment of an inner member of the apparatus of FIG. 1.
Figure 4B:
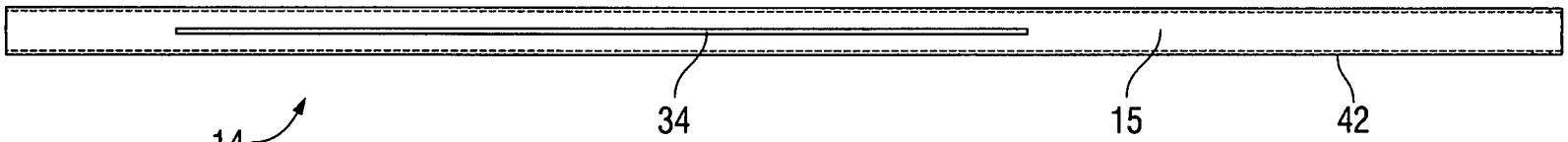
FIG. 4B depicts a side view of the inner member of FIG. 4A.
Figure 6:
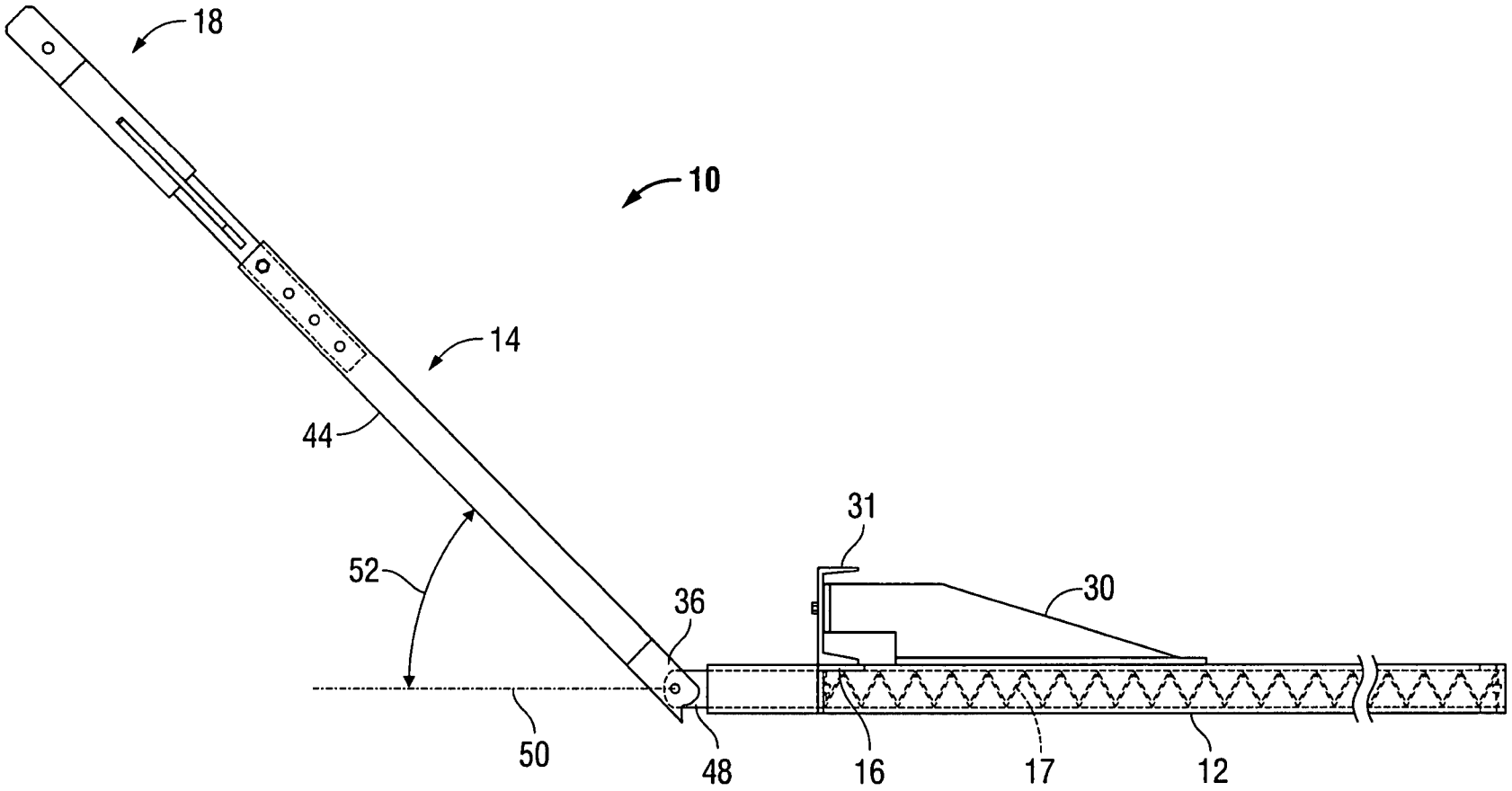
FIG. 6 depicts a side view of the apparatus of FIG. 1 in an extended position.

FIGS. 4A and 4B depict top and side views, respectively, of a first portion (42) of the inner member (14), which together with a second portion and a hinge assembly (as shown in FIG. 6), form the entirety of the inner member. The depicted embodiment of first portion (42) functions as a "slide housing," usable to limit the movement of the inner member (14) relative to the outer member and towed vehicle. The first portion (42) is shown as a hollow member (e.g., a segment of aluminum square tubing), having a bore (15) therein; however, it should be understood that the first portion (42) can include any shape and/or dimension, and can be wholly or partially hollow or solid, as desired, without departing from the scope of the present disclosure.

An engagement orifice (54) is shown, which is usable to receive the counter sunk screw (shown in FIG. 3A), or a similar fastener, pin, or other means of connection, to secure the inner member (14) to the outer member. A slot (34) is also shown formed in the side of the first portion (42). While FIG. 4B depicts only a single side of the first portion (42), a similar slot can be formed in the opposite side thereof. In other embodiments, one or more slots could be formed in the top and/or bottom of the first portion (42). A pin, fastener, and/or other type of protruding member extending from the interior of the housing can extend into the slot (34), and/or through the slot (34) and inner member (14) if an additional slot is formed in the opposing side thereof, such that as the inner member (14) is moved (e.g., telescopingly) relative to the outer member, the slot (34) moves relative to the protruding member extending therein. The slot (34) thereby limits the movement of the inner member (14) relative to the housing through contact between the protruding member and the edges of the slot (34), which enables the apparatus to be easily and readily extended a fixed length corresponding to the horizontal distance necessary for the head to be pivoted angularly to engage an outboard motor or other object and can prevent extension of the inner member (14) a length that could disengage the inner member (14) from the housing.

FIGS. 5A and 5B depict top and side views, respectively, of a hinge assembly (36) usable to pivotally connect two portions of the inner member, thereby providing a second portion (44) of the inner member with an angular range of motion relative to the first portion (42). Specifically, the hinge assembly (36) is shown having a first side (38) and a second side (40), which are engaged together via a series of overlapping flanges with aligned bores (39) running therethrough, that can accommodate a connector, e.g., via a pin-in-hole engagement. Each side (38, 40) of the hinge assembly (36) includes one or more holes (46) extending therethrough, which can be aligned with corresponding holes in the first and second portions (42, 44) of the inner member for engagement therewith, e.g., via use of pins, bolts, and/or similar fasteners. Similarly, the shaft portion (26) of the head is shown engaged to the second portion (44) of the inner member using a bolt (27) that extends through aligned bores within the shaft portion (26) and second portion (44). As such, the depicted hinge assembly (36) is usable to provide an angular range of motion between the housing and towed vehicle, secured to the first portion (42) of the inner member, and the head, secured to the second portion (44) of the inner member.

A pin (47), which can be secured to the housing (12), is shown extending into the first portion (42) of the inner member, e.g., into the slot (shown in FIG. 4B) thereof, such that contact between the pin (47) and the slot limits movement of the inner member relative to the housing. An additional pin (45) is shown, to which a spring or similar biasing member (17, shown in FIGS. 1 and 6) can be attached, the biasing member (17) thereby connecting the pin (45) to the second portion (44) of the inner member, such that the inner member is continuously biased toward a retracted position. The hinge assembly (36) is shown having a protruding portion (48) extending from the second side (40) thereof, usable to prevent retraction of the inner member into the housing in the manner described previously and depicted in FIG. 6, described below.

FIG. 6 depicts a diagrammatic side view of the apparatus (10) of FIG. 1 in an extended position. Specifically, the housing (12) is shown engaged to a lower portion (31) (e.g., a channel web) of a trailer or similar towed vehicle (not shown), through use of bolts that extend through the flanges (16, 30) thereof. As described previously, other methods of connection are usable, or alternatively, the housing (12) can be formed as a preexisting part of the towed vehicle such that no additional connection thereto is necessary.

The inner member (14) is shown engaged with and extending from the housing (12). Specifically, the second portion (44) of the inner member (14), having the head (18) attached thereto is shown telescopically extended outward from the housing (12), e.g., along line (50), then angularly pivoted in an upward direction, e.g., along line (52), using the hinge assembly (36). Movement of the first portion (44) of the inner member (14) relative to the towed vehicle in this manner enables the head (18) to be both laterally and angularly moved into an extended position, as shown, suitable for engagement with an outboard motor or other object, while movement of the first portion (44) in the reverse direction enables the inner member (14) to be inserted within the housing (12) (e.g., retracted therein), such that the apparatus (10) is disposed substantially underneath the towed vehicle when not in use. When in the extended position, as shown, the protruding portion (48) of the hinge assembly (36) contacts the edge of the housing (12), such that the retraction of the inner member (14) caused by the spring (17) is prevented.

Figure 7:
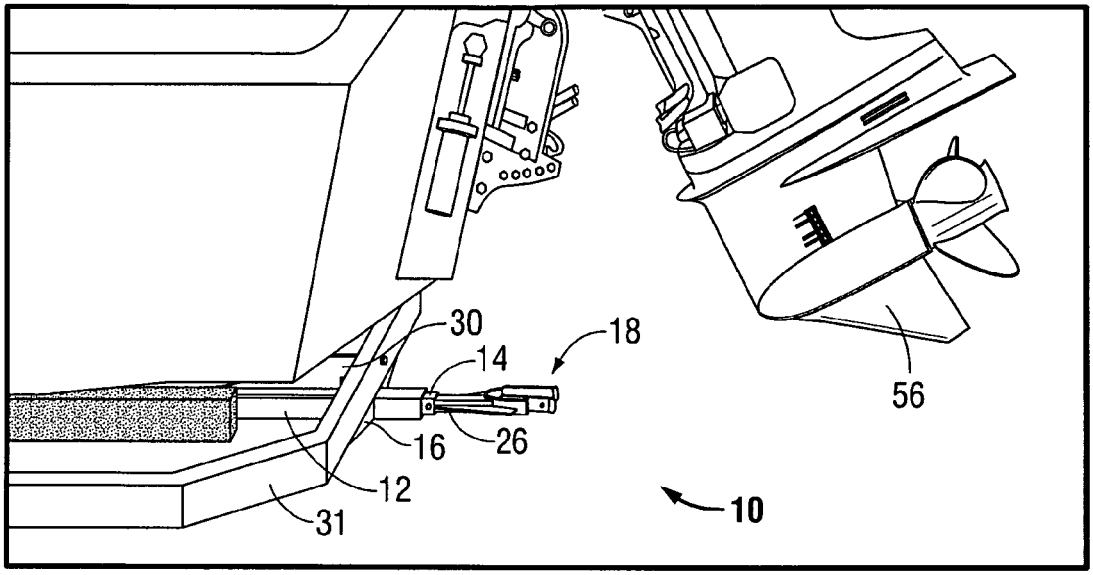
FIG. 7 depicts a side view of the apparatus of FIG. 1 engaged to the underside of a trailer.

FIG. 7 depicts a side view of an embodiment of an apparatus (10) usable within the scope of the present disclosure engaged with a lower portion (31) (e.g., a channel web) of a trailer (54). As described previously, the apparatus (10) is shown including a housing (12) secured to the lower portion (31) of the trailer (54) via connectors installed through side flanges (16) and an upper flange (30), such that the housing (12) is affixed substantially underneath the trailer (54). An inner member (14) with a head (18) attached thereto is shown in a retracted position (e.g., when not in use), inserted within the housing (12), such that the substantial entirety of the apparatus (10) is positioned beneath the trailer (54) for convenient storage and transport, while minimizing the chance of loss, damage, or theft.

Figure 8:
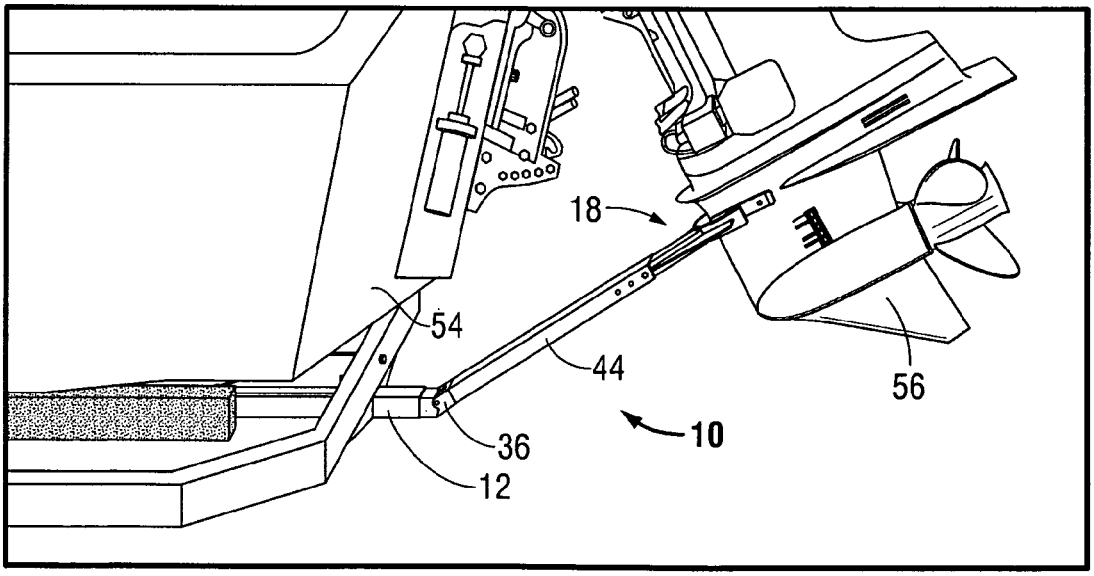
FIG. 8 depicts a side view of the apparatus of FIG. 7 in an extended position, engaged with an outboard motor of a watercraft.

FIG. 8 depicts a side view of the apparatus (10) of FIG. 7 in an extended position. Specifically, the second portion (44) of the inner member is shown extended from the housing (12) in a lateral direction (e.g., through telescopic movement relative to the housing (12)), then pivoted upward relative to the first portion (not visible in FIG. 8) of the inner member using the hinge assembly (36), such that the head (18) engages an outboard motor (56) of a watercraft. As described previously, contact between a protruding portion of the hinge assembly and the housing (12) can prevent retraction of the second portion (44) into the housing (12), such that the apparatus (10) remains secured in the position shown, thereby stabilizing the outboard motor (56) against undesired movement that could damage the watercraft, the trailer (54), or other objects.

As such, embodiments of the present apparatus can be secured to a trailer or other towed vehicle and used to secure outboard motors and/or other objects by extending a first member (e.g., an inner member) relative to a second member (e.g., a housing), against the force of a biasing member that urges the first member toward a retracted position. At least a portion of first member can then be pivoted relative to the second member such that a head thereon can contact and/or otherwise engage and stabilize an outboard motor or other object, while pivoting of the first member into an angled position prevents retraction thereof. When the apparatus is no longer needed, the head can be disengaged from the outboard motor, the first member can be pivoted toward a generally straight orientation, and then retracted relative to the second member (e.g., into the housing), such that the apparatus can be retained in secure association with a trailer, in a position that is convenient for storage, while minimizing the potential for loss, damage, or theft.

While various embodiments usable within the scope of the present disclosure have been described with emphasis, it should be understood that within the scope of the appended claims, the present invention can be practiced other than as specifically described herein.

What is claimed is:

1. An apparatus for stabilizing an outboard motor of a watercraft during transport by a towed vehicle, the apparatus comprising:

a body comprising an outer member secured to the towed vehicle and an inner member disposed within the outer member and telescopingly movable relative thereto between an extended position and a retracted position;

a biasing member engaged with the inner member, wherein the biasing member urges the inner member toward the retracted position; and a head formed at an end of the inner member, wherein the head is adapted to contact and stabilize the outboard motor during transport by the towed vehicle, wherein the inner member comprises a hinge assembly defining a first portion pivotally movable relative to a second portion between an angled position and a straight position, wherein the body is secured to an underside of the towed vehicle and the inner member is disposed underneath the towed vehicle within a housing when in the retracted position, and wherein contact between the first portion and the outer member prevents movement of the inner member toward the retracted position when in the angled position.

2. The apparatus of claim 1, wherein at least one of the first portion and the outer member comprise a protruding portion, and wherein the other of the first portion and the outer member contacts the protruding portion when the first portion is in the angled position.

3. The apparatus of claim 1, wherein the head is adjustably secured to the inner member for enabling the head to be positioned relative thereto to engage outboard motors of varying size and position relative to the towed vehicle.

4. The apparatus of claim 1, wherein at least one of the outer member and the inner member comprise an opening formed therein, wherein the other of the outer member and the inner member comprises a protruding member positioned in the opening, and wherein contact between a perimeter of the opening and the protruding member limits movement of the inner member relative to the outer member.

5. The apparatus of claim 1, wherein the head is removably engaged with the inner member for enabling the head to be interchanged with an additional head adapted for contacting outboard motors of a differing size, a differing position, or combinations thereof relative to the towed vehicle.

6. An apparatus for stabilizing an outboard motor of a watercraft during transport by a towed vehicle, the apparatus comprising:

a body comprising an outer member connectable to the towed vehicle and an inner member disposed within the outer member and telescopingly movable relative thereto between an extended position and a retracted position; and a head at an end of the inner member, wherein the head is adapted to contact the outboard motor during transport by the towed vehicle, wherein the inner member comprises a hinge assembly defining a first portion pivotally movable relative to a second portion between an angled position and a straight position, wherein contact between the first portion and the outer member prevents movement of the inner member toward the retracted position when in the angled position, and wherein the hinge assembly is telescopingly movable into and out of the outer member.

7. The apparatus of claim 6, wherein the inner member is disposed underneath the towed vehicle within a housing when in the retracted position.

8. The apparatus of claim 6, wherein the head is adjustably secured to the inner member for enabling the head to be positioned relative thereto to engage outboard motors of varying size and position relative to the towed vehicle.

9. The apparatus of claim 6, wherein the head is removably engaged with the inner member for enabling the head to be interchanged with an additional head adapted for contacting outboard motors of a differing size, a differing position, or combinations thereof relative to the towed vehicle.

10. The apparatus of claim 6, wherein the apparatus additionally comprises a biasing member engaged with the inner member, and wherein the biasing member urges the inner member toward the retracted position.

* * * * *